US005682183A

United States Patent [19]

Wade et al.

[11] Patent Number: 5,682,183

[45] Date of Patent: Oct. 28, 1997

[54] INK LEVEL SENSOR FOR AN INKJET PRINT CARTRIDGE

[75] Inventors: John M. Wade, Poway; Christopher J. Shultz, San Diego, both of Calif.; Betsy C. Huntingdon, West Lafayette, Ind.

[73] Assignee: Hewlett-Packard Company, Palo Alto, Calif.

[21] Appl. No.: 332,544

[22] Filed: Oct. 31, 1994

Related U.S. Application Data

[63] Continuation-in-part of Ser. No. 156,172, Nov. 22, 1993.

[51] Int. Cl.[6] ..... B41J 2/195; B41J 29/373

[52] U.S. Cl. ..... 347/7; 347/19; 347/60

[58] Field of Search ..... 347/7, 14, 17, 347/18, 60, 19

[56] References Cited

U.S. PATENT DOCUMENTS

| | | | |
|---|---|---|---|
| 5,206,668 | 4/1993 | Lo et al. | 347/6 |
| 5,418,558 | 5/1995 | Hock et al. | 347/14 |
| 5,428,376 | 6/1995 | Wade et al. | 347/14 |

*Primary Examiner*—Mark J. Reinhart
*Assistant Examiner*—Craig A. Hallacher
*Attorney, Agent, or Firm*—Dennis G. Stenstrom

[57] ABSTRACT

Disclosed is a method of determining imminent ink exhaustion in a thermal inkjet print cartridge based on the discovery that ink drop volume falls at a faster rate at high frequency firing rates than at low frequency firing rates as ink supply diminishes. The method includes warming the print cartridge printhead and ink to a predetermined temperature; then operating the print cartridge printhead at a first firing frequency to eject a volume of ink, said operating step including heating the ink and printhead, carrying away heat in the ejected volume of ink, and conveying a volume of cooler ink to the printhead to replace the ejected volume; and monitoring a first temperature change from the predetermined temperature. Then warming the same print cartridge printhead and ink to a predetermined temperature; operating the print cartridge printhead at a second firing frequency which is different than the first firing frequency to eject a volume of ink, said operating step including heating the ink and printhead, carrying away heat in the ejected volume of ink, and conveying a volume of cooler ink to the printhead to replace the ejected volume; and monitoring a second temperature change from the predetermined temperature. The first and second temperature changes are compared to indicate a low ink supply. The method is quickly and readily performed by a printer before printing or between printing intervals. The indication of low ink supply can be used to develop printer shutdown, or use of a reserve print cartridge, or an operator warning, or a combination of these tactics.

20 Claims, 13 Drawing Sheets

INK LEVEL SENSOR FOR AN INKJET PRINT CARTRIDGE

CROSS-REFERENCE TO RELATED APPLICATIONS

This application is a continuation-in-part application of co-pending U.S. application Ser. No. 08/156,172, filed Nov. 22, 1993 entitled "INKDROP-VOLUME TEST USING HEAT-FLOW EFFECTS, FOR THERMAL-INKJET PRINTERS," by John M. Wade. This application also relates to the subject matter disclosed in co-pending U.S. application Ser. No. 08/145,904, filed Oct. 29, 1993, entitled "THERMAL TURN-ON ENERGY TEST FOR AN INKJET PRINTER;" U.S. application Ser. No. 08/056,698 filed Apr. 30, 1993, entitled "METHOD FOR DETECTING AND CORRECTING AN INTRUSION OF AIR INTO A PRINTHEAD SUBSTRATE OF AN INK JET CARTRIDGE;" and U.S. patent application filed concurrently herewith, entitled "OUT OF INK DETECTOR FOR AN INKJET PRINTHEAD," Attorney Docket No. 1093509-1. The above co-pending applications are assigned to the present assignee and are incorporated herein by reference.

FIELD OF THE INVENTION

The present invention generally relates to inkjet and other types of printers and, more particularly, to the ink supply to a print cartridge of an inkjet printer.

BACKGROUND OF THE INVENTION

An ink jet printer forms a printed image by printing a pattern of individual dots at particular locations of an array defined for the printing medium. The locations are conveniently visualized as being small dots in a rectilinear array. The locations are sometimes called "dot locations", "dot positions", or "pixels". Thus, the printing operation can be viewed as the filling of a pattern of dot locations with dots of ink.

Ink jet printers print dots by ejecting very small drops of ink onto the print medium, and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The printheads of thermal ink jet printers are commonly implemented as replaceable printhead cartridges which typically include one or more ink reservoirs and an integrated circuit printhead that includes a nozzle plate having an array of ink ejecting nozzles, a plurality of ink firing chambers adjacent respective nozzles, and a plurality of heater resistors adjacent the firing chambers opposite the ink ejecting nozzles and spaced therefrom by the firing chambers.

To print a single dot of ink, an electrical current from an external power supply is passed through a selected thin film resistor. The resistor is then heated, in turn superheating a thin layer of the adjacent ink within a vaporization chamber, causing explosive vaporization, and, consequently, causing a droplet of ink to be ejected through an associated nozzle onto the paper.

An important consideration in thermal-inkjet printer operation is exhaustion of the ink supply in each print cartridge reservoir. Some printers have drop sensors for determining photoelectrically when a print cartridge (or individual ink chamber) is not firing, so that the printer can be shut down and an alarm or indicator actuated to alert the operator to replace the print cartridge and thereby avoid wasting time and paper. Such a system is useful, but generally provides only an indication that ink is already exhausted. A preferable system would alert the operator that ink is about to run out.

Existing inkjet printers are unable to detect depletion of their ink supply and consequently, they sometimes attempt to print with a depleted ink supply. It would be advantageous to have a device that automatically detects and corrects for a depleted ink supply. This device would prevent the printhead substrate from printing when empty and would prevent the temperature of the printhead substrate from reaching dangerously high levels which can damage the firing resistors in thermal inkjet printers.

The ability to detect and correct for a depleted ink supply is also an important requirement for print cartridges installed in facsimile machines, because the data is lost if not printed out correctly. If the receiver does not have a printed record of who made the transmission, this data is irretrievably lost. The ability to detect and correct for a depleted ink supply is also an important feature of printers that create large color plots that require a large investment of ink and print time that would be lost if the ink supply becomes depleted during creation of the plot. Large volume printers, where the user is often absent, must be able to detect and correct for a depleted ink supply to prevent them from attempting to print with an empty print cartridge for an extended time. The corrective action may be to stop printing, alert the user to the impending exhaustion of ink supply and move the inkjet cartridge to a position where the inkjet cartridge can be replaced.

Accordingly, the prevailing technology has not heretofore provided an entirely satisfactory way to provide advance warning that an inkjet print cartridge is about to run out of ink.

SUMMARY OF THE INVENTION

When a thermal inkjet print cartridge operates to eject ink, three things happen at once: (1) heating by the heating resistor with flow of heat into the thermal mass of the ink chamber; (2) cooling by heat drain toward the reservoir, print cartridge body and to ambient; and (3) cooling by carrying away of heat in the ink drops and replacement by cooler ink from the reservoir. The larger the drop, the greater the amount of heat it carries away and the greater the amount of cooling produced by its replenishment flow.

The present invention is a method of determining imminent ink exhaustion in a thermal inkjet print cartridge based on the discovery that ink drop volume falls at a faster rate at high frequency firing rates than at low frequency firing rates as ink supply diminishes. The method comprises warming the print cartridge printhead and ink to a predetermined temperature; then operating the print cartridge printhead at a first firing frequency to eject a volume of ink, said operating step including heating the ink and printhead, carrying away heat in the ejected volume of ink, and conveying a volume of cooler ink to the printhead to replace the ejected volume; and monitoring a first temperature change from the predetermined temperature. Then warming the same print cartridge printhead and ink to a predetermined temperature; operating the print cartridge printhead at a second firing frequency which is different than the first firing frequency to eject a volume of ink, said operating step including heating the ink and printhead, carrying away heat in the ejected volume of ink, and conveying a volume of cooler ink to the printhead to replace the ejected volume; and monitoring a second temperature change from the predetermined temperature. The first and second temperature changes are compared to indicate a low ink supply.

The method is quickly and readily performed by a printer before printing or between printing intervals. The indication of low ink supply can be used to develop printer shutdown, or use of a reserve print cartridge, or an operator warning, or a combination of these tactics. The corrective action may be to stop printing, alert the user to the imminent out of ink condition and moving the inkjet cartridge to a position where the inkjet cartridge can be replaced. The alert provided to the user may be by a light or audible signal from the printer, or by a message on the screen or audible sound from the computer controlling the print operations, or both.

In a printer that has at least two print cartridges the corrective action may also include the option of putting into service another print cartridge. This arrangement is particularly beneficial in printing equipment that is used on an unattended basis, as for example a facsimile machine, since such devices are generally operated overnight and on weekends, when no operator is available to change print cartridges.

DETAILED DESCRIPTION OF THE PREFERRED EMBODIMENTS

Figure 1:
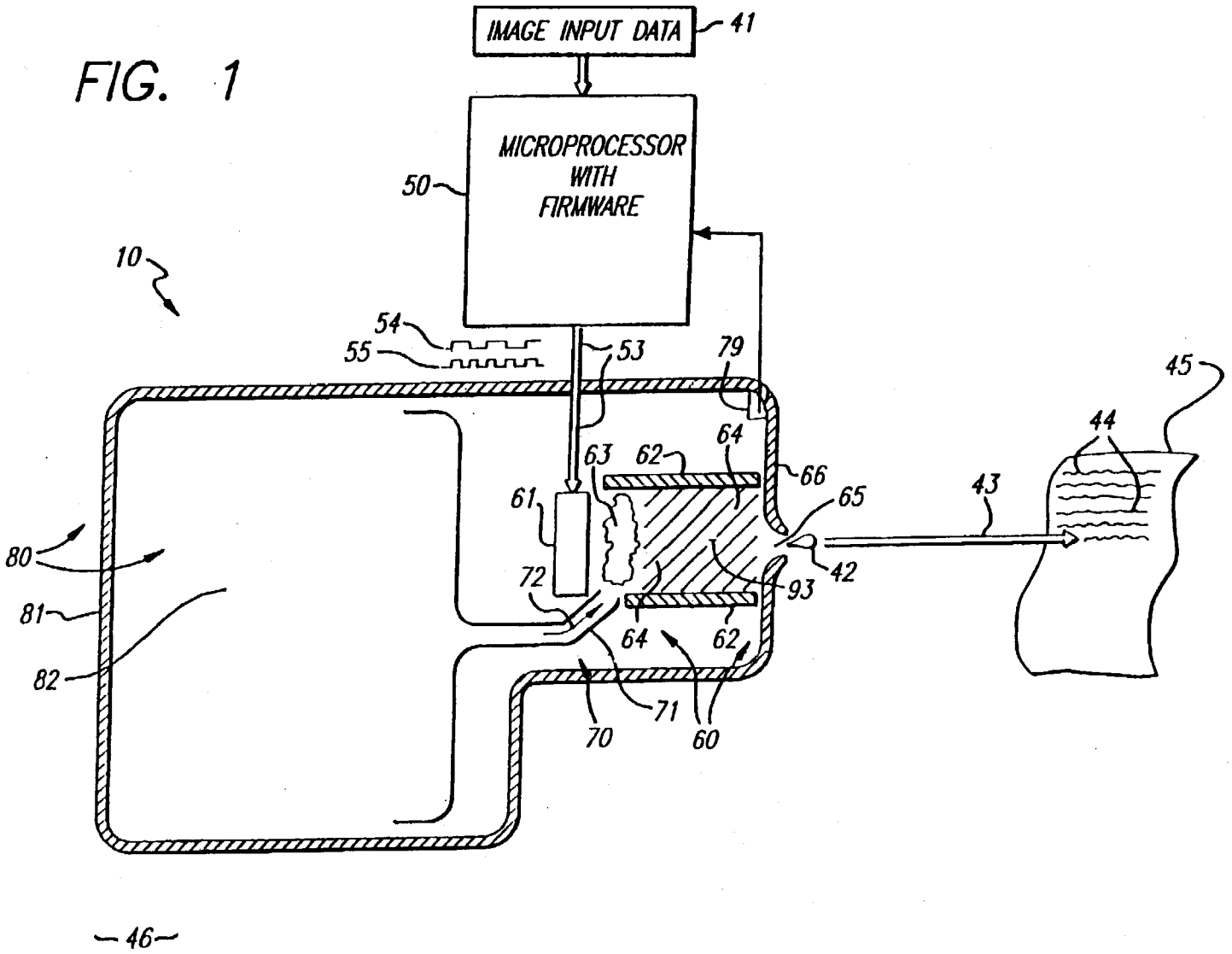
FIG. 1 is a highly schematic representation of a thermal inkjet printer, including a thermal inkjet print cartridge with a representative ink chamber.

As FIG. 1 indicates, each representative ink chamber 60 in a thermal inkjet printer is part of an electrical system controlled by microprocessor 50 that receives input digital image data 41 and responds by controlling the marking 42–44 on a sheet 45 of printing medium. Microprocessor 50 also controls and performs the measurements and calculations of the present invention. Ink chamber 60 is also part of a thermal system that directs heat to the printhead, stores some of that heat, and drains some of it, in various ways that depend on what the printer is doing. Thus, the ink chambers 60 within the print cartridge 10 operate as parts of a thermal system, to ascertain what amount of ink 42 is being ejected. As shown in FIG. 1, each ink chamber 60 includes a heating resistor 61, which for purposes of the thermal system acts as a heat source. The heating resistor 61, however, also itself has thermal mass. Immediately adjacent to the heater resistor 61 are other thermal components which also have thermal mass: barrier walls 62, a propulsion bubble 63 when one is present within the ink chamber, liquid ink 64 within the ink chamber, and an associated portion 66 of an orifice member containing an orifice or nozzle 65. All of the above thermal components 61–66 are considered for analytical purposes, to be lumped together as a single thermal mass of the ink chamber 60.

Communicating with the ink chamber 60 and ink 64 therein is an extended standpipe 71 that directs ink 72 from a print cartridge reservoir ink supply 82 within the print cartridge body 81, into the ink chamber 60. This extended standpipe 71 and ink 72 within it also have thermal mass, which on average is much less intimately associated thermally with the thermal mass of the ink chamber 60, but much more closely associated with the ink chamber 60 than are the ink 82 in the reservoir and the print cartridge body 81. The standpipe 71 and ink 72 together are considered for analytical purposes as an intermediate composite thermal mass 70. There is a thermal drain from the ink chamber thermal mass 60 to the intermediate thermal mass 70. The print cartridge body 81 and ink 82 form another, relatively remote composite thermal mass 80. Accordingly, there is a leakage route for thermal drain from the intermediate thermal mass 70 to the remote thermal mass 80.

Within the thermal system, the two primary operative parameters are (1) the thermal mass 60 of the ink chamber and (2) its leakage path to the intermediate thermal mass 70. Further, however, the system includes thermal drain paths from the remote thermal mass 80 to ambient 46. The thermal mass of, and drain paths to and from, the remote thermal mass 80 are much slower acting than the previously discussed thermal elements more closely associated with the ink chamber 60. In fact they are so much slower that, once the system is in general terms up to temperature the thermal mass 80 and drain paths associated with the reservoir ink 82 and body 81 may not only be lumped together as thermal mass 80, but effectively disregarded, i.e., treated as associated with ambient 46. This simplification yields satisfactory results because the phenomena that are closely connected with ejected ink volume operate on a scale of just a few seconds and are much faster than the heating or cooling of the pit cartridge reservoir ink 82 and body 81.

FIG. 1, shows the conveying away of heat by ejected ink drops 42, and replacement of the corresponding ink volume by a replenishing ink flow 72 from the reservoir 82 via the standpipe 71 when the print cartridge is firing drops 42. This heat removal with the firing of ink drops 42 is combined with the replenishment ink 72 in cooling the ink chamber 60.

Figure 2A:
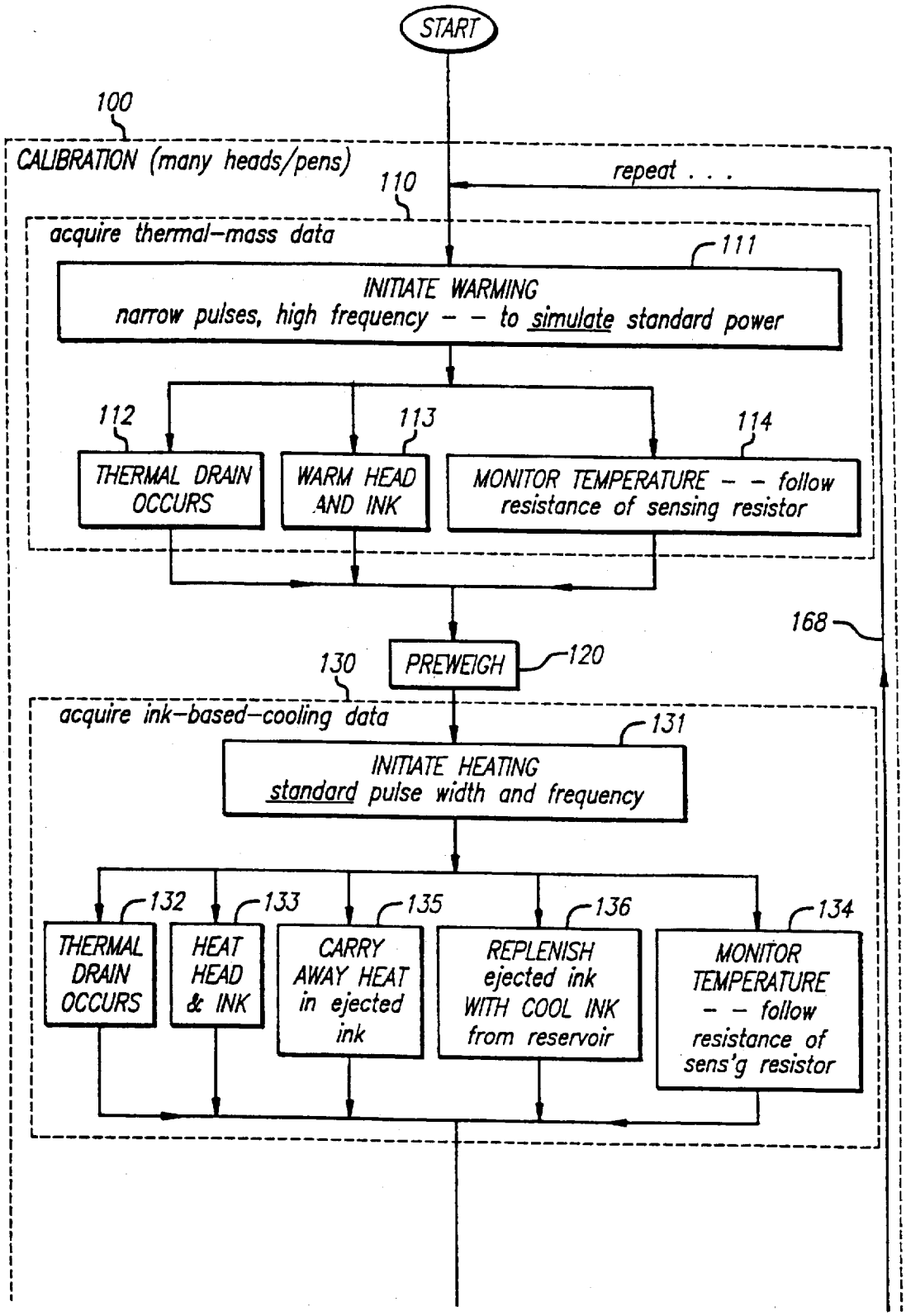
FIG. 2 is a logic flow diagram showing the procedures for determining drop volumes.
Figure 2B:
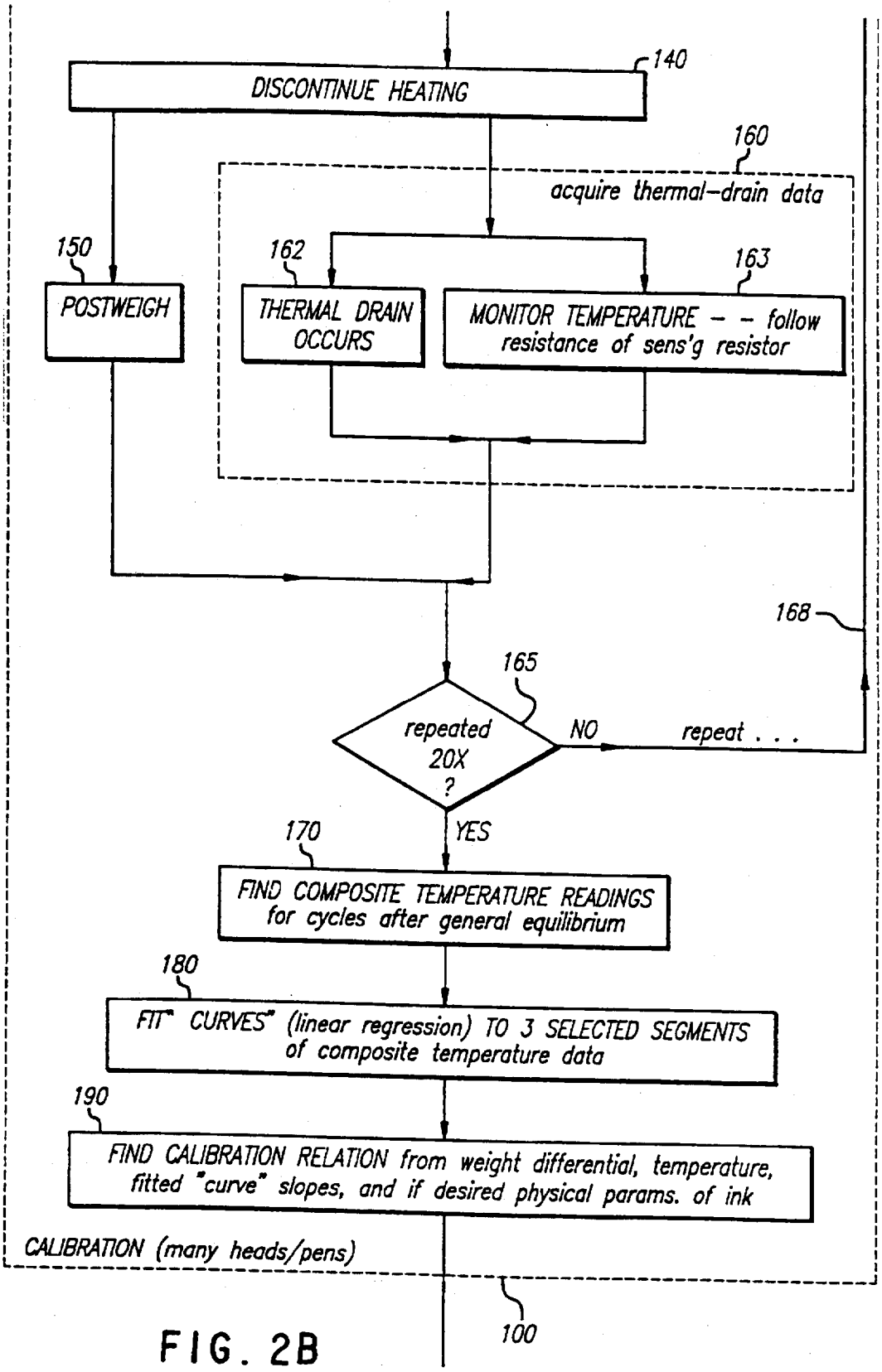
Figure 2C:
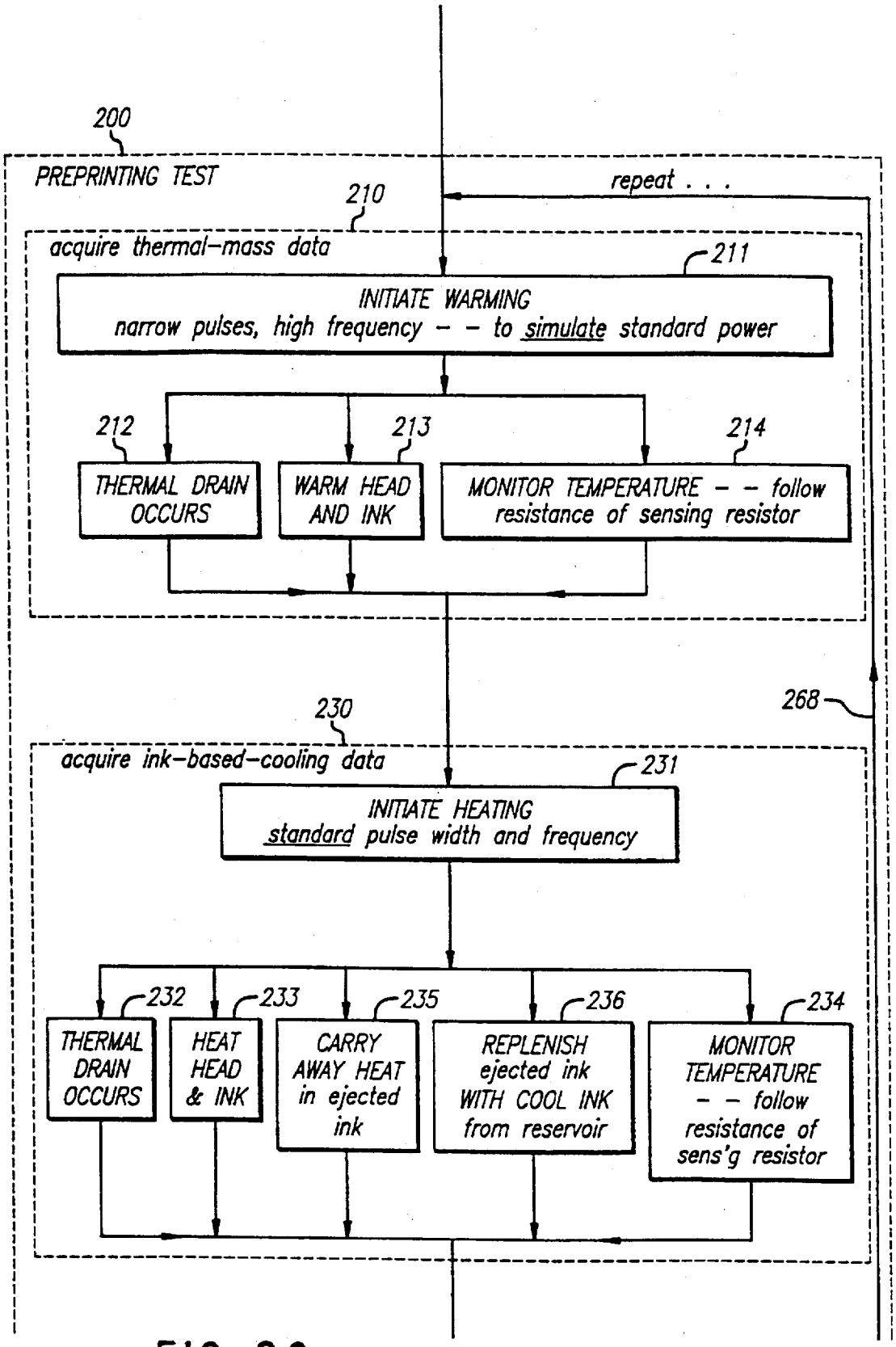
Figure 2D:
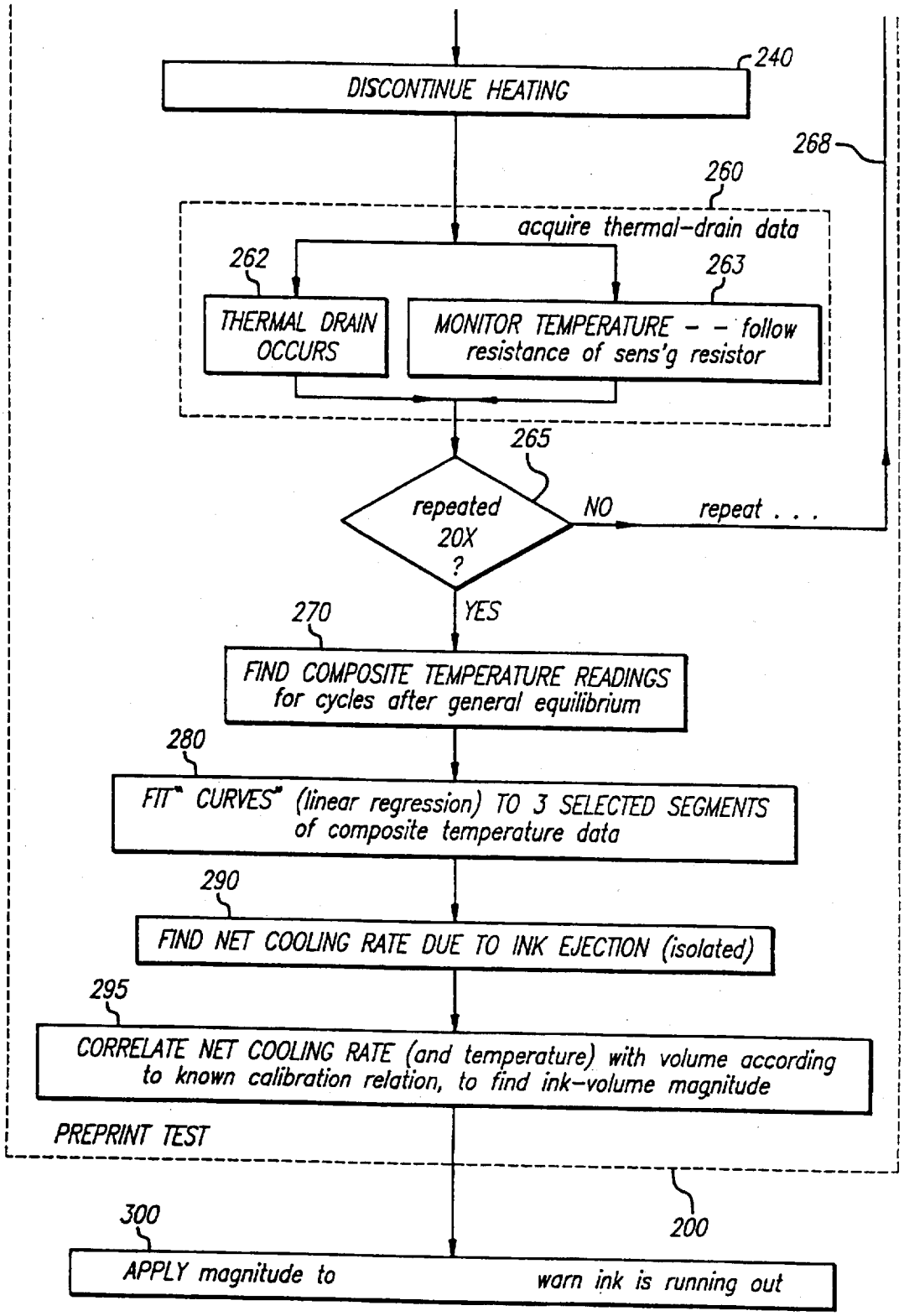

The invention contemplates warming 211, 213 (FIG. 2C) the ink chambers 60 for a selected time interval for each ink chamber 60, but without firing the heater resistor 61 to eject ink drops 42. The object of this warming is to enable acquisition 210, 214 and storage of data related to the aggregate ink chamber thermal mass, or equivalently data concerning the heat flow into and out of that thermal mass.

For this purpose, warming power pulses 55 are directed to the heating resisters 61 of the ink chambers 60 via the same actual electrical connections 53 as used for firing the ink chambers 60 to eject ink drops 42. These pulses 55 may be at the same voltage and power as the printer uses when producing ink drops 42, but to prevent the ink chambers 60 from ejecting ink at this stage of the procedure, the pulses 55 used are typically narrower than those 54 used to eject ink from the ink chambers 60.

To compensate for the narrowness of the pulses, the pulse frequency is made proportionately higher. By way of explanation, the term "warming" is used here only to help in distinguishing this step of the procedure from the analogous step, denominated "heating" or "firing", which uses substantially the same overall power, but wider pulse widths to produce ink ejection.

During warming 213, heat drain 212 from the ink chambers to the intermediate thermal mass naturally takes place too, and in addition some heat flows (not illustrated in FIG. 2) into or out from the thermal mass. While these phenomena occur, the microprocessor 50 automatically monitors 214 the printhead temperature, preferably by following the resistance of the built-in thermal sensing resistor 79, storing data at intervals closely spaced in time, such as preferably fifty milliseconds. This stored data provides information about the aggregate thermal mass of the ink chambers 60, but as will be understood the separation of this information from the effects of the static heat drain 212 requires acquisition of other data as well.

Next the system proportionally increases the pulse width and reduces the pulse frequency to again provide 231, 233 the normal power input 54 used to eject ink drops. Some of this input heat flows into the thermal mass 60, and some flows 232 through the drain path to the intermediate thermal mass 70 (and thence to the reservoir ink 82 and print cartridge body 81), while the system automatically monitors 234 the printhead temperature.

In addition, however, now ink 42 is ejected and this ink 42 carries away 235 heat. Furthermore, volumetric replacement 236/72 of that ink from the normal supply path has the effect of bringing cooler ink 72 into the ink chambers 60 from the intermediate thermal mass 70. The result is to acquire 234 information related to the cooling produced by these phenomena. Additional steps will be required to separate this information from the already acquired information about the thermal mass of the ink chamber 60, and also from the static thermal drain as mentioned above.

Next the system stops 240 the heat input to the heater resistors 61 and monitors 263 the rate of temperature decrease to learn the magnitude of the thermal drain 262/232/212 path to the intermediate thermal mass 70. When heat input is discontinued 240 and the printhead is not firing ink drops 42, the only significantly operative components in the thermal system are the ink chamber thermal mass and the drain path to the intermediate thermal mass 70.

The temperature $T_{70}$ of the intermediate thermal mass 70 is needed to develop a value for the temperature differential $\Delta T$ of the ink chambers 60 relative to the intermediate thermal mass 70. From the thermal masses and drain paths 86, 87 to the print cartridge reservoir and body it might be possible to obtain a relatively more accurate value of $T_{70}$ by extrapolation back to the starting point of the passive decay. However, it is preferable to deduce $T_{70}$ from the measured before and after weights of the print cartridge 10 and contained ink 82.

The ink chamber 60 to intermediate thermal mass 70 drain path is relatively more consistent, as between different ink chambers 60 and as between different print cartridges 10, than the path corresponding to heat carried off in the ejected ink 42. Therefore, reasonable results could be obtained by measuring in advance an average value for the drain path, over a fairly large number of ink chambers 60 and print cartridges 10, and then assuming that average value was applicable to all ink chambers 60 in all print cartridges 10.

The drain path to the intermediate thermal mass 70, however, also dominates the thermal loss corresponding to heat carried away by ejected ink drops 42. For this reason it is preferable to actually perform this measurement 210, automatically, for each aggregation of ink chambers 60, or in other words for each print cartridge 10.

Figure 3:
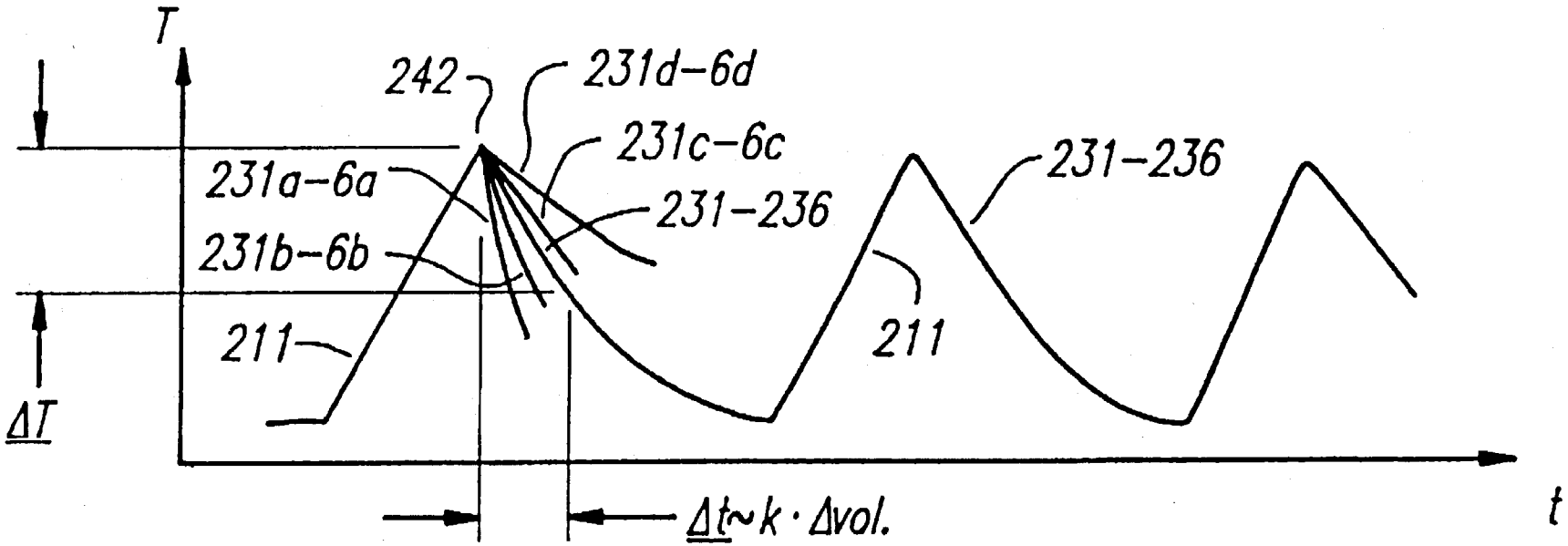
FIG. 3 is a conceptual graph of temperature versus. time in a simplified series of pre-warming and ink ejecting cycles.

If the warming 210 and heating/firing 230, but not the drain determination 260, are repeated several times, the resulting temperature versus time behavior may be as shown generally in the simplified conceptual graphs of FIG. 3. The slope 231–236 (corresponding to the like numbered portions of FIG. 2) of the downward portion of the graph in each cycle is related to the drop volume. In other words, steeper slopes 231*a*–236*a*, 231*b*–236*b* or shallower slopes 231*c*–236*c*, 231*d*–236*d* result from ejection of, respectively, greater or lesser drop volumes.

However, as will be seen below, while the above may illustrate a procedure adequate for finding ink ejection volume in some printers, a preferred procedure is to incorporate the thermal drain measurements discussed in connection with FIG. 2. For purposes of an automated test to determine cooling rate it is possible to either measure the differential $\Delta T$ through which the temperature falls in a pre-selected time interval $\Delta t$, or to measure the time $\Delta t$ required for the temperature to fall through a preselected differential $\Delta T$. In either method the measured differential is related through the absolute temperature to the ejected volume.

However, for best results, it is preferable to use neither of these methods, but rather to acquire data for a considerably larger number of time points, i.e., to iterate 268 (FIG. 2) so that the overall data are reliable and then form a composite 270 for at least two of the iterations and to fit 280 straight lines to certain segments of the composite data by linear regression. The slopes 290 of these fitted lines, are then used as representative of the slopes of interest, in calculating a measure of the net cooling rate due to ink ejection, isolated from the effects of thermal mass and static thermal drain. Finally, the resulting measure can be rendered 295 in terms of ink volume magnitude, and this overall result applied 300 for a beneficial purpose such as, warning of imminent ink exhaustion.

As to the processes 290, 295 for determining a measure of ink drop cooling in isolation, each ink drop carries away an amount of energy proportional to its volume and absolute temperature, or, considering only the net energy carried to the intermediate thermal mass 70, proportional to its temperature differential above the intermediate thermal mass 70. Thus knowing the cooling rate, the temperatures, and the calibration relation permits deduction 290, 295 of the drop volume being ejected.

More specifically, adjusting the observed cooling rate for the known thermal drain through the print cartridge body 81 and for the known heat input 91, and dividing the adjusted cooling rate by the temperature above that of the intermediate thermal mass 70, and by the numerical rate of drop 42 ejection, yields 260 the volume of each drop 42.

This value for drop volume includes effects of tolerances in ink properties, heating resistance, ink chamber dimensions (sizes and relative placements of the resistor, cell walls and orifice), and back pressure at the standpipe 71. This value for drop volume, for reasons mentioned earlier, is not readily measured individually for each ink chamber, but an average for all ink chambers is preferably measured for each print cartridge by each printer.

In preparation for doing so, however, the entire three stage measurement must be carried out 100 (FIG. 2A) in advance, preferably for many print cartridges, but also incorporating determination 120, 150 of the amount of ink actually fired, to develop a reliable calibration relationship. It is that relationship which then can be used 290, 295 in the field to find the rate of ink volume ejection from the observed net cooling rate.

For this purpose, the amount of ink actually fired in this third stage 130 of the calibration sequences 100 is readily determined by weighing the print cartridge before 120 and after 150 ejecting a known number of drops whose cooling effect has been observed. For best results, this weighing should be performed before and after the identical drop ejection sequence 130 used to find the cooling effect. This is important because the weight differential to be determined is rather small.

To obtain good precision it is also useful to average the rate of temperature change within each stage of the temperature versus time sequence, respectively, i.e., temperature fall 160, 260 with no input power, temperature rise 110, 210 with input power, and temperature fall 130, 230 at a lower rate due to firing the print cartridge.

Figure 4:
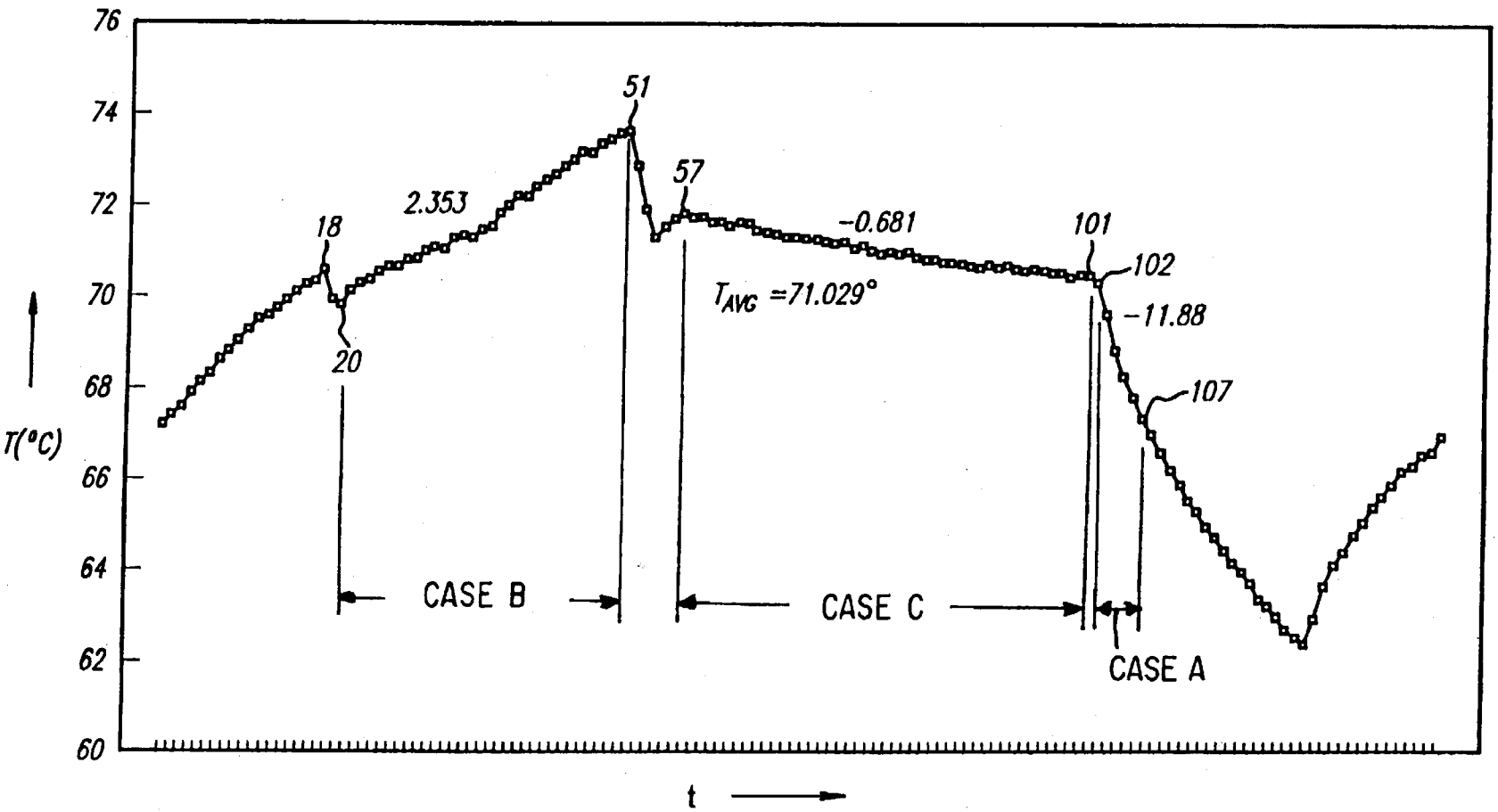
FIG. 4 is a composite graph of actual temperature versus time data acquired using a more complex warming/ink ejecting/cooling cycle.

FIG. 4 shows actual data representing a composite of the last eighteen of twenty monitored thermal cycles. The dots are spaced relative to the abscissa at fifty millisecond intervals, and dots of particular significance are numbered. Values along the ordinate represent temperature in degrees centigrade. The discontinuities at dots numbered 18 through 20, and at dots 51 through 57, are artifacts due to switching and the like in the electronics.

Figure 6A:
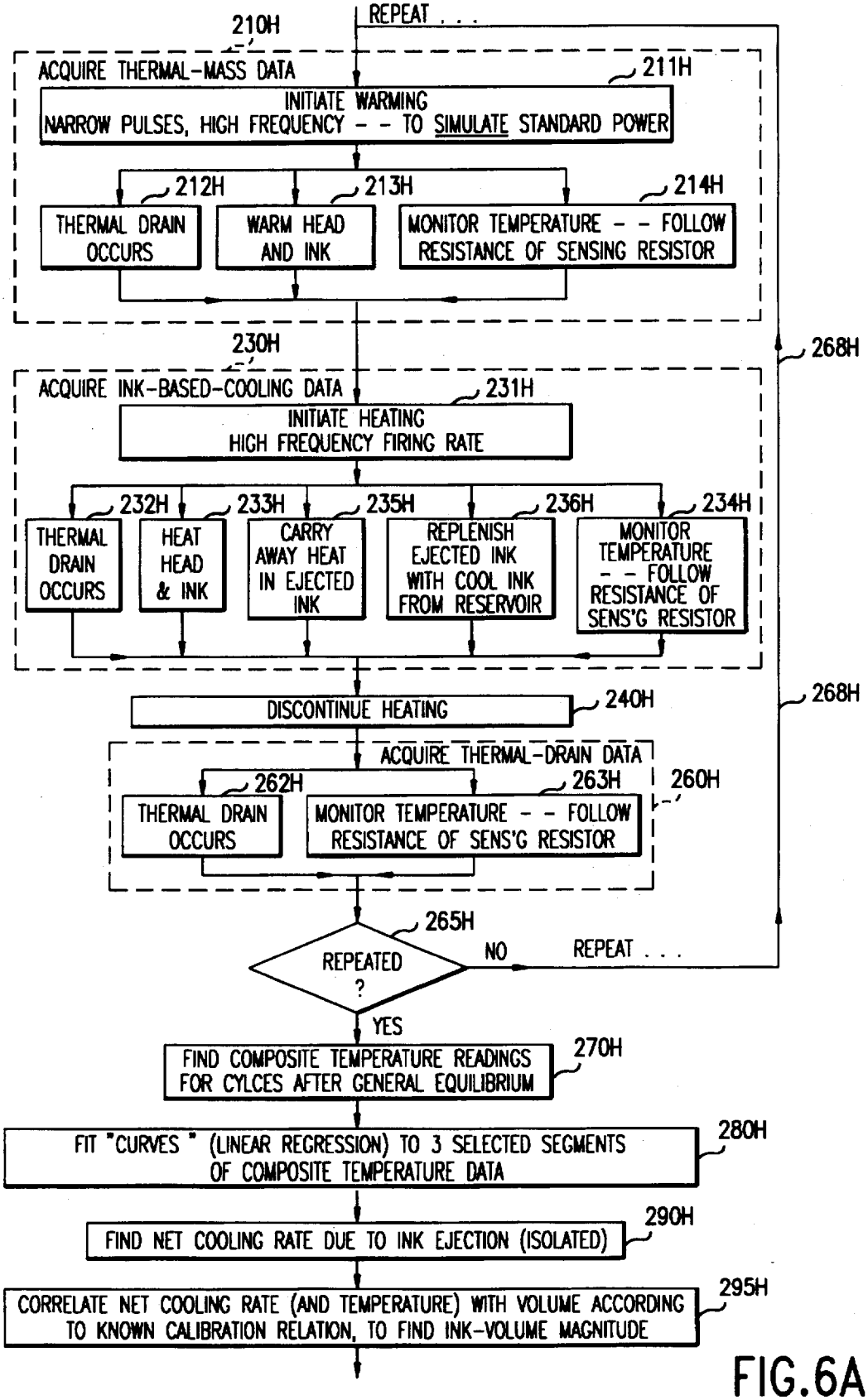
FIG. 6 is a logic flow diagram showing the procedures of a first embodiment of the present invention for determining ink level.
Figure 6B:
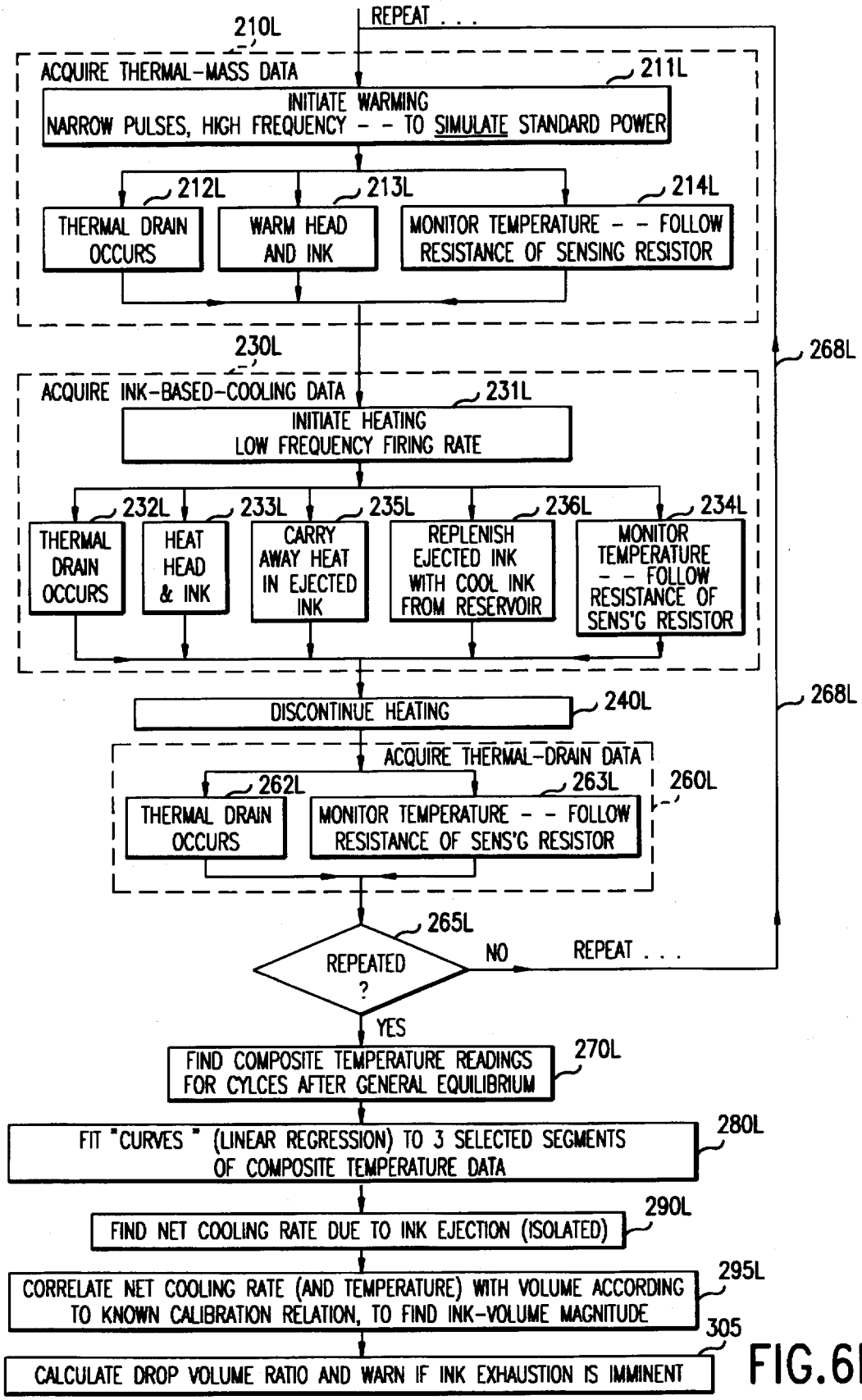

The segment of the composite graph from dots 102 through 107 represents data acquired during thermal drain cooling only, in other words, monitoring of the system with no power applied to the ink chamber's heaters and with no ink being ejected. For definiteness this condition will be called "Case A" and exhibits a downward (negative) slope of about 12° C./sec, as marked on FIG. 6. This part of FIG. 4 corresponds directly to the acquisition 160, 260 of thermal drain data in FIG. 2.

Next the segment from dots 20 through 51, "Case B", represents data during warming of the ink chambers with narrow power pulses at an operating frequency higher than normal, so as to simulate normal heating, but without ink ejection. This pulse warming, represented with respect to power input and absence of ink ejection as "Case B" corresponds to the acquisition 110, 210 of thermal mass data in FIG. 2, is superimposed upon the thermal drain cooling of Case A, and results in a net upward slope of nearly 2.5° C./sec as indicated.

The segment from dots 57 through 101 is "Case C"; it corresponds to the acquisition 130, 230 of ink based cooling data in FIG. 2. These data were acquired during substantially normal operation, in other words, with heating at ordinary pulse frequency and pulse width, so as to eject ink at a rate within the normal operating range. In this mode of operation the ink ejection accordingly is superimposed upon the heating effects of Case B as well as the thermal drain cooling of Case A.

Here the slope is downward but slight, and has magnitude just below 0.7° C./sec. Using the values indicated on the diagram, the three slopes are roughly $s_a$=−11.9, $S_b$=+2.4, and $s_c$=−0.68; these values may be taken as typical for a current production printheads.

For Case C as marked the average temperature for the entire segment (dots 57 through 101) is just over 71° C., which may be taken as approximately 50° C. above typical ambient or roughly 40° C. above the intermediate thermal mass. The average temperatures for the other two segments (Cases A and B) are both roughly equal to this value.

As will be evident the temperature for Case A (the steeper decline at the right) is about two degrees lower. This difference is held to such a small value by using only the first few data points of the steep decline. In practice it is natural to start with Case B, then proceed to Case C and finally to Case A.

The purpose in using twenty iterations of the measurement cycle was primarily to demonstrate the accuracy of the measurement process. In practice, volume indications are extracted from just one or two cycles. During the warming segment, which is Case B, preferably each heating pulse is 0.8 μsec long; these pulses are at 6 kHz, to each ink chamber. The average power into the ink chamber is 2.1 W, and this warming continues for 3.2 seconds. During the ink ejecting (or more familiarly "spitting") part of the cycle, Case C, the duration of each heating pulse is 2.4 μsec and the frequency of the pulses is 2 kHz, to each ink chamber. The power continues at 2.1 W for 2.4 seconds. The passive thermal drain part of the cycle, Case A, has no associated heating pulses and lasts for one second.

Now to be described is how the results of these measurements can be used to find the average volume of each ink drop. That volume, in cubic centimeters per drop, is given first by $v=F/\nu$, where F represents the volumetric flow rate of ink, cubic centimeters per second, and the Greek letter $\nu$ represents the firing frequency, i.e., number of drops per second.

Next F can be related to the amount of heat O transferred in time $\Delta t$ by:

$$O=\rho c F \Delta T \Delta t,$$

where:

$\rho$ is the density (g/cc) of the ink, c is the specific heat (cal/g°C.) of the ink, and $\Delta T$ is the temperature differential (°C.) above the temperature of the intermediate mass.

Hence the volume v of each drop is $F/\nu=O/(\nu\rho c\Delta T\Delta t)$. Because the amount of heat injected into the system in terms of watts is known, it is convenient to relate the rate of heat transfer in terms of calories $O/\Delta t$ to power P expressed in watts, flowing out of the system with a stream of ink drops, by $$4.18 O/\Delta t(cal/sec)=P_{out}(W),$$

so the average drop volume is $$v(cc)=P_{out}/(4.18\nu\rho c\Delta T).$$

Temperature $\Delta T$ (°C.) above that of the intermediate thermal mass is known, as are c and $\rho$ for the ink and the firing rate $\nu$.

Therefore it remains only to show how a value for the power $P_{out}$ carried away in the ink stream can be automatically approximated through simple monitoring of temperature changes under controlled conditions, as suggested above.

Referring to Case A, under the circumstances represented there, no power is being injected into the system and no ink is flowing out. Hence the heat flow i is only that flowing out of the system from the thermal capacitance C through the composite thermal resistance R to ambient or intermediate thermal mass temperature.

That heat flow $i_R$ obeys the conventional relation, $$i_{R(a)}/C=(\Delta V/\Delta t)_a,$$

where the subscript "a" indicates that this relation is being applied to Case A. For simplicity's sake the slope $(\Delta V/\Delta t)_a$ for this Case A will be denominated $s_a$, so that the heat flow $i_{R(a)}$ out through the thermal resistance R can be written $$i_R=s_aC.$$

Next proceeding to Case B, still no ink flows but heat $i_{in}$ is being pumped into the system by applying power to the heater resistors which actuates the printhead. For practical systems of interest, $i_{in}$=2.1 W, which is nominally equal to the power level used in normal operation of a ink chamber.

As shown in the diagram, heat flow $i_{C(b)}$ is now into the thermal capacitance C, rather than out of the thermal capacitance as in Case A. Because the average temperature now is roughly the same as in Case A, however, the outward heat flow $i_R$ through the thermal resistance to ambient as equal to that occurring in Case A. This assumption allows a summary of the heat flow relations as thus:

$$(i_{in}-i_R)/C=(\Delta V/\Delta t)_b\equiv s_b,$$

where for this Case B an abbreviated notation for the slope $s_b\equiv(\Delta V/\Delta t)_b$ is introduced to simplify later expressions, as with the notation given above for Case A.

Now combining the two expressions involving the heat flow $i_R$ through the thermal resistance, and involving also the thermal capacitance C, found from Cases A and B, it is possible to eliminate the value $i_R$ and so find the thermal capacitance:

$$(i_{in}-i_R)/C=s_b$$

$$i_{in}-i_R=Cs_b$$

$$i_{in}-Cs_a=Cs_b$$

$$C=i_{in}/(s_a+s_b).$$

Now reintroducing the expression for heat flow through the thermal resistance, $$i_R=Cs_a=i_{in}s_a/(s_a+s_b),$$

in which all the parameters appearing on the right side can be found through the automatic monitoring processes.

What is actually sought, however, is a value more closely related to the outward flow of ink, namely the heat flowing out with the ink, as in Case C. Once again for Case C, the starting points are fundamental expressions, the relation for heat flow out of the thermal capacitance, and the balance between heat flows in the three other legs of the system:

$$i_{C(c)}=C(\Delta V/\Delta t)_c\equiv Cs_c,$$

$$i_{out}=i_{in}+i_{C(c)}-i_R$$

and the heat flow $i_R$ through the thermal resistance is again taken as roughly equal to those in Cases A and B, since the average temperature is roughly the same. Now the thermal capacitance C is already known from the previous derivations, while the slope $s_c$ for this case, like the first two, is subject to observation through monitoring. Consequently the heat flow out with the ink in this case can be expressed as:

$$i_{out}=i_{in}+i_{C(c)}-i_R$$

$$i_{out}=i_{in}+Cs_c-i_R$$

$$i_{out}=i_{in}+i_{in}s_c/(s_a+s_b)-i_{in}s_a/(s_a+s_b).$$

Now collecting terms, simplifying, and inserting the results into the initial expression for drop volume:

$$i_{out}=i_{in}\,(1+s_c/(s_a+s_b)-s_a/(s_a+s_b))$$

$$i_{out}=i_{in}\,(s_a+s_b+s_c-s_a)/(s_a+s_b)$$

$$i_{out}=i_{in}\,(s_b+s_c)/(s_a+s_b)$$

$$v(cc)=\frac{i_{in}\,(s_b+s_c)}{4.18\,\nu\rho c\Delta T\,(s_a+s_b)}\,.$$

Using values noted in FIG. 4 for slopes $s_a$=−11.9, $s_b$=2.4, $s_c$=−0.68 and temperature ΔT=71−56=15° C. relative to the intermediate thermal mass, setting the input power $i_{in}$=2.1 W at ν=300 kHz (representing 2 kHz to each of an assumed one hundred fifty ink chambers), and further using representative ink values ρ=1.03 g/cc, c=1 cal/g°C., yields a typical inkjet drop size: 24 pL.

As described above, out of ink sensing was possible by monitoring the ink drop volume over the life of the print cartridge. Toward the end of life, the drop volume begins to drop because the back pressure in the ink reservoir increases. The present invention is an improved "out of ink" sensor which uses the discovery that the drop volume at a high frequency firing rate declines faster than the drop volume at a low frequency firing rate, as back pressure increases. This is because the ink chamber refill rate is governed in part by the back pressure which affects high frequency operation more than low frequency operation.

Figure 5:
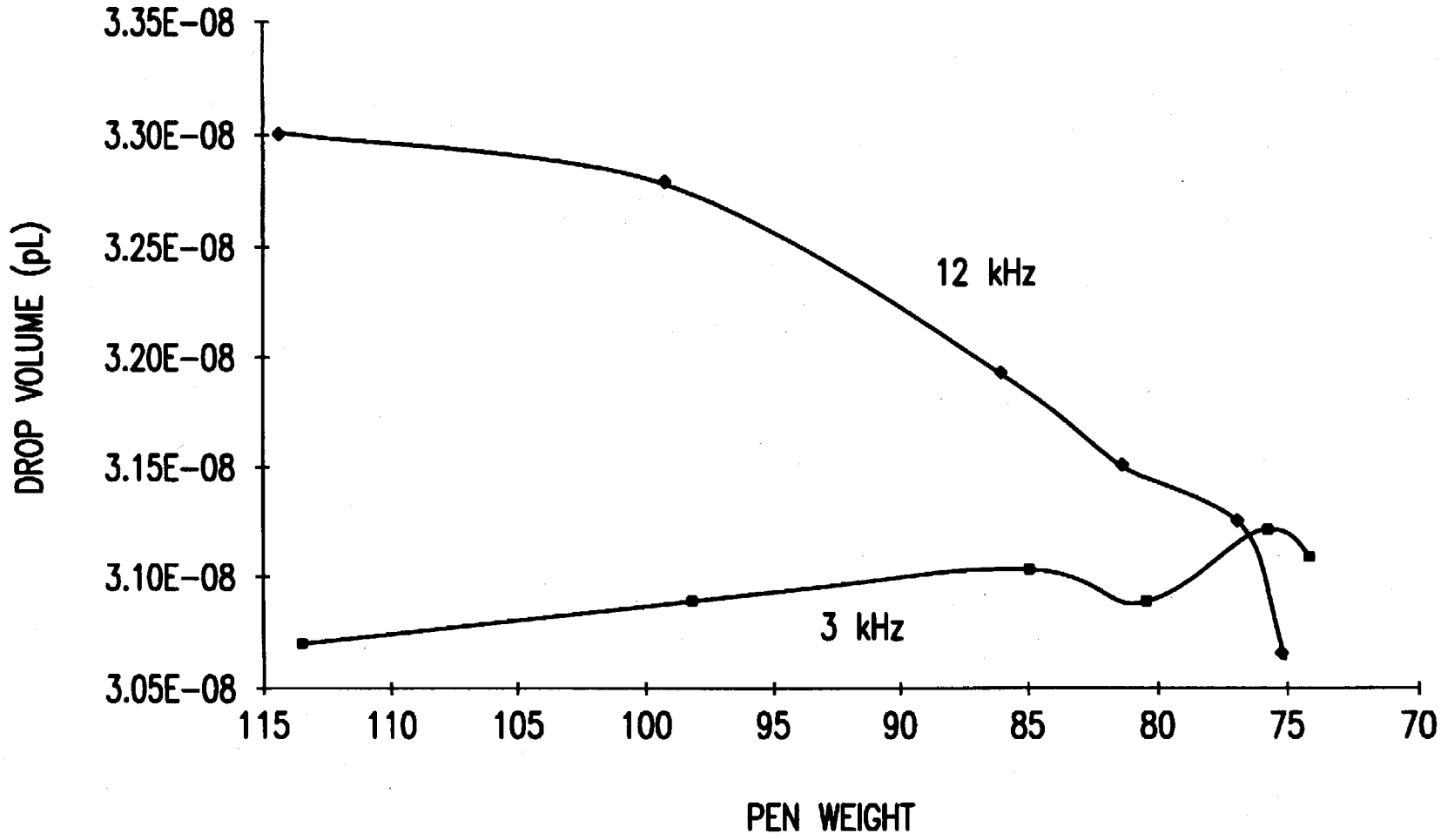
FIG. 5 is a graph of drop volume versus pen weight for firing frequencies of 12 kHz and 3.7 kHz.

FIG. 5 shows the drop volume over the life of a print cartridge at 3.7 and 12 kHz and shows the decrease in drop volume at 12 kHz as the ink is depleted and the back pressure in the ink reservoir increases. The data for FIG. 5 was obtained by printing and counting the number of drops fired and then weighing the print cartridge, or "pen," to find the amount of ink depleted at various intervals during the life of the cartridge. The drop volume was then determined by dividing the volume of ink depleted, determined by weighing, by the number of drops fired, determined by counting. A print cartridge weighs approximately 115 grams when full and approximately 71.5 grams when empty. The reason for the drop volume at 12 kHz being larger than at 3.7 kHz during the early life of the print cartridge is due to a phenomenon known as ink chamber "overshoot" during high frequency refill. For a description of the factors involved with high frequency ink refill, see co-pending U.S. patent application filed Oct. 6, 1994, entitled "Inkjet Printhead Architecture for High Speed Ink Firing Chamber Refill," Attorney Docket No. 1094609-1.

To make the drop volume measurements, the average power needs to be held nearly constant. Power delivered to the printhead is the product of pulse width, firing frequency and number of ink chambers fired (i.e., resistor/nozzles). When only one firing frequency was involved, this was accomplished using pulse width and frequency control while firing the same number of ink chambers. For a period of warming pulses, a narrow pulse width and a high frequency was used. For a period of ink ejection firing pulses at the same average power, a proportionally wider pulse width and lower frequency was used. Now that the same average power at two firing frequencies must be maintained, another means of controlling power must be used. This is accomplished by firing a proportionally fewer number of ink chambers at high frequency than at low frequency, thus once again achieving a constant average power delivered to the printhead. Thus, the procedures set forth above and shown in FIGS. 2 and 6 can be used to obtain the drop volume at both high and low firing frequencies. Only the firing or spitting operation is performed at high and low frequencies. The drop volumes can then be calculated as described above and the results from high and low frequencies can be compared.

Many of the factors that affect drop volume discussed above affect both high and low frequencies more or less equally. Accordingly, making drop volume measurements at both low and high frequency operation and computing the ratio at various times during print cartridge life can be used to reduce the uncertainties in the drop volume measurement described above. This is because the factors causing uncertainties in absolute drop volumes affect drop volumes at both high and low frequencies almost equally and thus cancel out when taking the ratio of the two drop volumes. Therefore, using the drop volume ratio is a much better low ink indicator than using the just comparing the drop volume measurement. However, to take full advantage of the present invention and the resulting reduced uncertainty in drop volume ratios, a simplified procedure may be used. Thus, to calculate the drop volume directly, the formula for drop volume, $$v(cc) = \frac{i_{in}(s_b + s_c)}{4.18\ \nu\rho c\Delta T(s_a + s_b)},$$

is used to calculate the ratio of drop volume for low frequency to high frequency, at constant power. Collecting terms and simplifying results in the following equation:

$$\text{Volume Ratio} = v_{lf}/v_{hf} = \frac{(s_b + s_c)_{lf}(s_a + s_b)_{hf}}{(s_a + s_b)_{lf}(s_b + s_c)_{hf}}$$

Since the cooling and pulse warming slopes, $s_a$ and $s_b$, respectively, are approximately the same for both high and low frequency operation of the printhead, they can be set constant. Accordingly, the above equation can be simplified as follows:

$$\text{Volume Ratio} = v_{lf}/v_{hf} = \frac{[s_b + (s_c)_{lf}]}{[s_b + (s_c)_{hf}]}$$

Therefore, variations in drop volume values are primarily generated from changes in slope, $s_c$, in the ink ejection phase of the procedure. While the above relationship is expressed in terms of the temperature slopes, one skilled in the art will appreciate that the above relationship also applies if the slopes are replaced by a using a temperature change between the initial temperature and a subsequent temperature at a specified time delay.

Figure 7A:
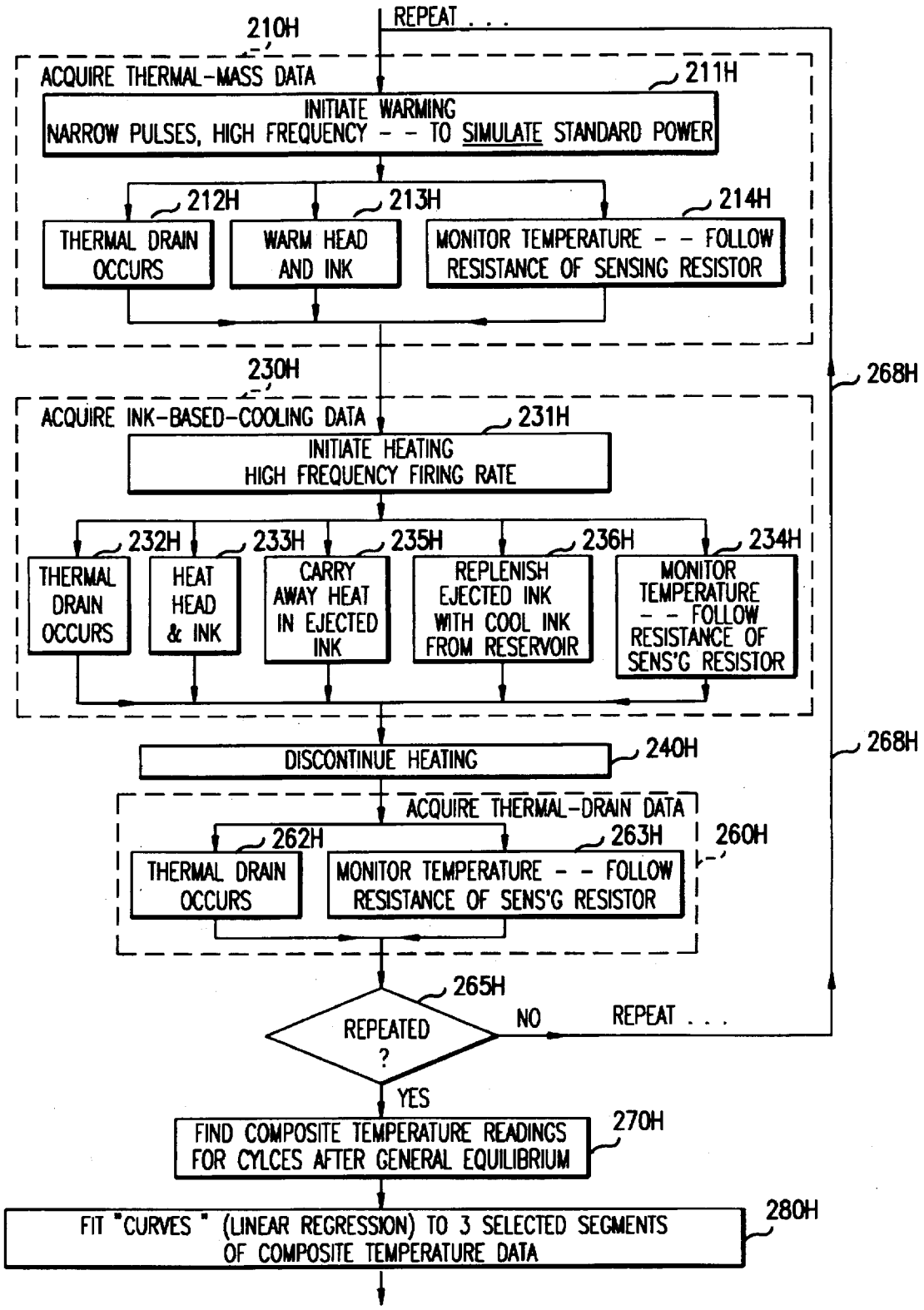
FIG. 7 is a logic flow diagram showing the procedures of a second embodiment of the present invention for determining ink level.
Figure 7B:
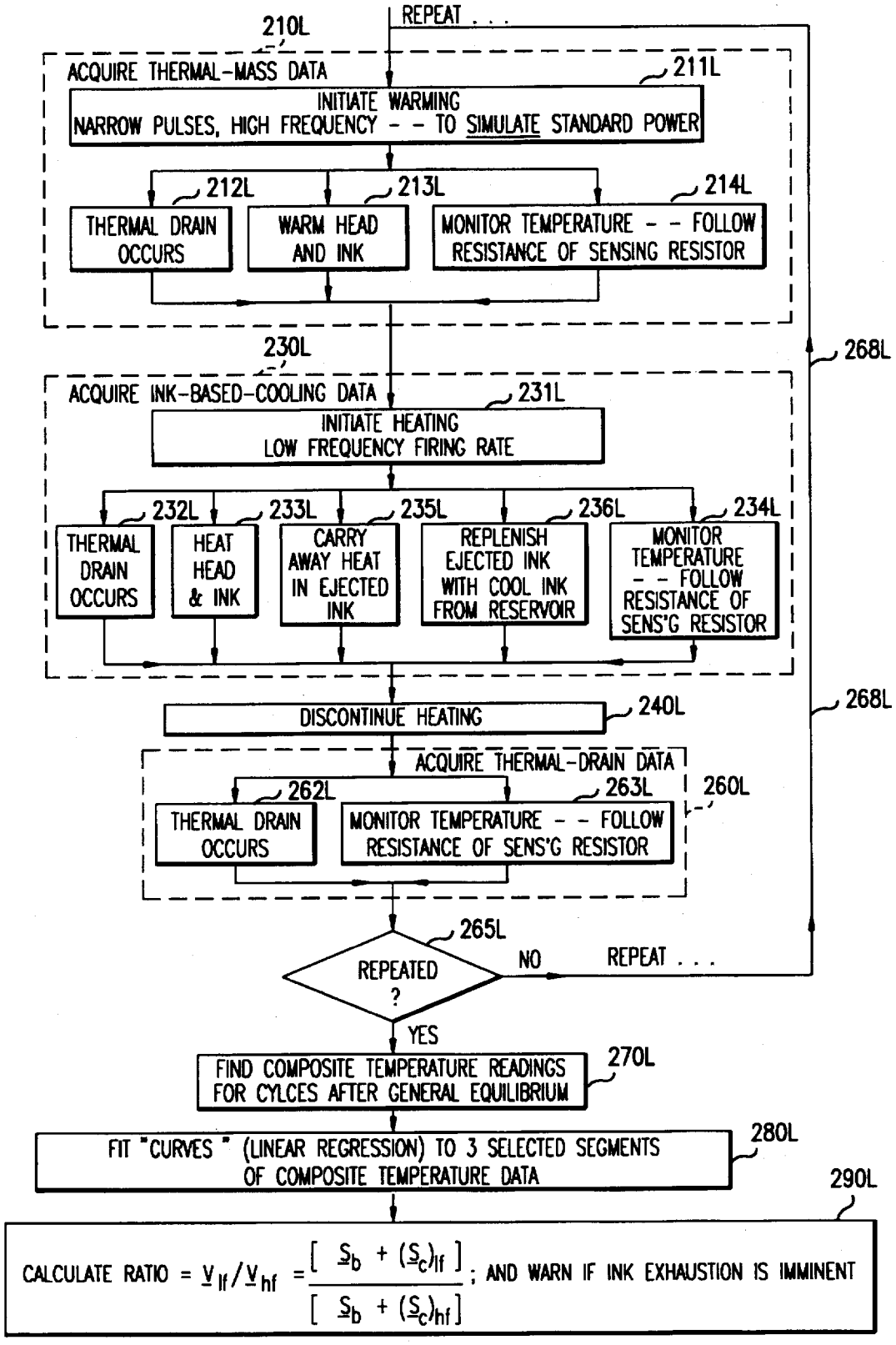
Figure 8:
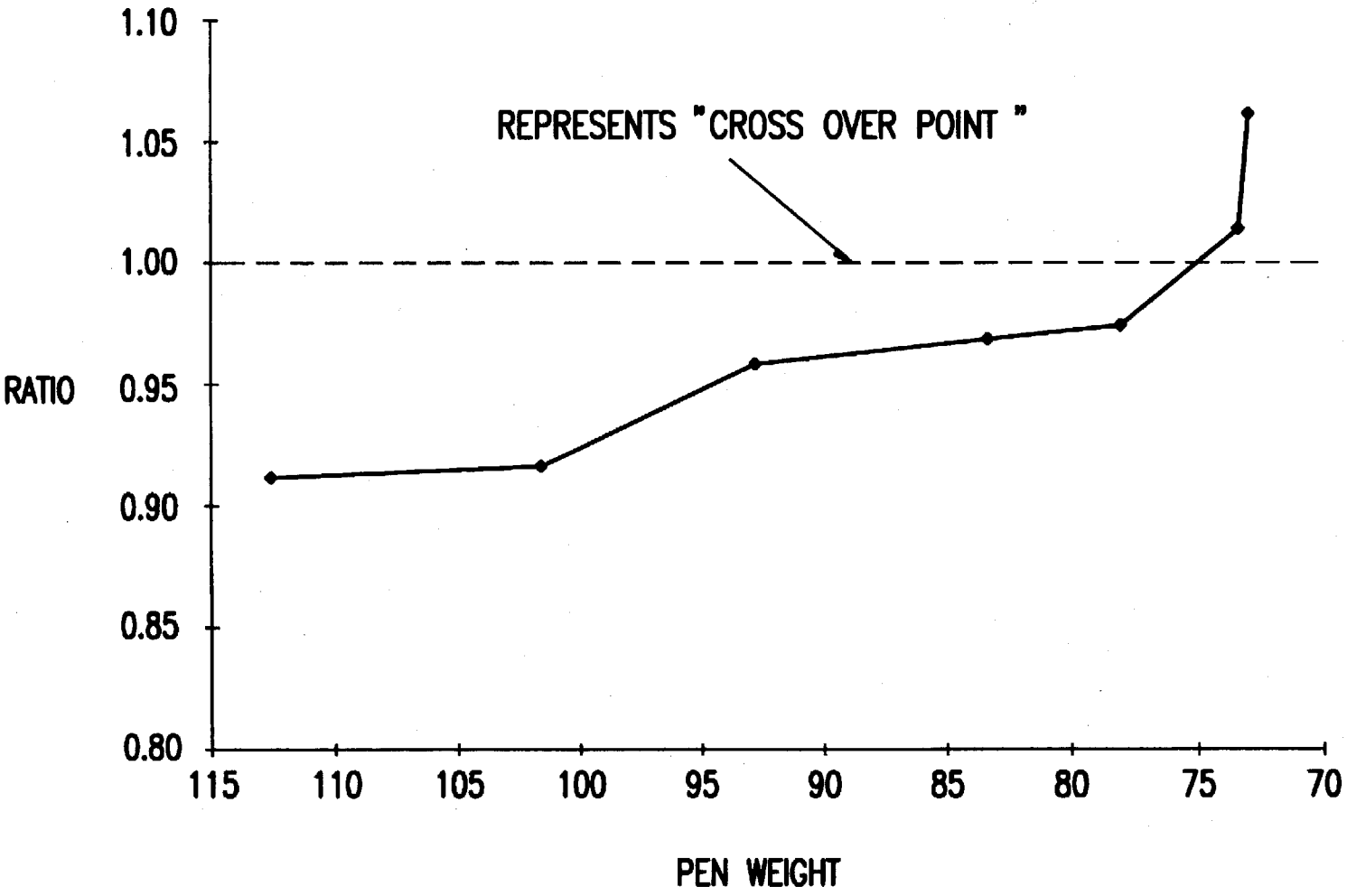
FIG. 8 is a graph of the ratio of drop volume at 3.7 kHz to drop volume at 12 kHz versus pen weight.

Performing the procedures and calculations as described above and shown in FIG. 7 at frequencies of 3.7 kHz and 12 kHz yields the results shown in FIG. 8. In performing the procedures shown in FIGS. 6 and 7, it is advantageous to perform the cycle several times sequentially to assure equilibrium, then discard the first cycles and average a selected number of cycles. The results shown in FIG. 8 were obtained by performing four cycles, discarding the first two and then taking the average of the last two.

Thus, independent of absolute drop values, the "drop volume" ratio behaves as discussed above, with a sharp rise in the "drop volume" ratio as the ink supply of the print cartridge nears exhaustion. This rise in "drop volume" ratio provides an indication to the printer that the print cartridge is about to run out of ink.

This indication can be used to develop printer shutdown, or use of a reserve print cartridge, or an operator warning to alert the user to the malfunctioning ink cartridge, or combinations of these actions as desired. The alert provided to the user to change the print cartridge may be by a light or audible signal from the printer, or by a message on the screen of, or audible sound from, the computer controlling the print operations, or both. The corrective action may also include moving the inkjet cartridge to a position where the inkjet cartridge can be replaced.

In a printer that has at least two print cartridges, this indication to take out of service a print cartridge for which ink exhaustion is imminent, may also include the option of putting into service another print cartridge. This arrangement is particularly beneficial in printing equipment that is used on an unattended basis, as for example a facsimile machine, since such devices are generally operated overnight and on weekends, when no operator is available in offices to change print cartridges.

The method is quickly and readily performed by a printer before printing, or between printing intervals.

The method is a very reliable out of ink level sensor, but since some amount of ink is used to perform it, a further optional embodiment of the present invention is to use other less reliable methods to indicate when the life of an ink cartridge the need for performing the test becomes necessary. One such preferred less reliable method is to count the drops ejected from a cartridge and using an average expected drop volume calculate the total volume of ink expelled. Since the initial volume of ink is known, it can be determined when the print cartridge is nearing empty and then begin performing the method of the present invention.

It will be understood that the foregoing disclosure is intended to be merely exemplary, and not to limit the scope of the invention, which is to be determined by reference to the appended claims.

What is claimed is:

1. A method of operating a thermal inkjet printer to indicate a low ink supply in a thermal inkjet print cartridge, comprising the following steps:

initially warming a printhead in the inkjet print cartridge to a first starting temperature;

initially operating the printhead by applying electrical pulses to an ink chamber in the printhead at a first firing frequency to eject a first volume of ink from the ink chamber, while monitoring the printhead temperature to obtain a first temperature change as compared to the first starting temperature;

subsequently warming the printhead in the inkjet print cartridge to a second starting temperature;

subsequently operating the printhead by applying electrical pulses to an ink chamber in the printhead at a second firing frequency, which is different than the first firing frequency, to eject a second volume of ink from the ink chamber, while monitoring the printhead temperature to obtain a second temperature change as compared to the second starting temperature; and comparing the first temperature change and second temperature change as a basis for indicating a low ink supply in the print cartridge.

2. The method of claim 1 wherein said initial warming step and said second warming step includes applying electrical pulses to an ink chamber on the printhead without ink ejection.

3. The method of claim 2 which further includes monitoring the printhead temperature during said initial warming and subsequent warming steps.

4. The method of claim 1 wherein said initial operating and subsequent operating steps include applying electrical energy pulses to a predetermined number of ink chambers on said printhead at pulse widths wide enough to fire ink from the pen.

5. The method of claim 1 wherein said initial operating and subsequent operating steps include applying electrical energy pulses to a predetermined number of ink chambers at a frequency low enough to fire ink from the pen and said initial warming and subsequent warming steps include applying electrical energy pulses to the ink chambers at a frequency too high to fire ink from the pen.

6. The method of claim 1 wherein said initial operating and subsequent operating steps include monitoring the printhead temperature by sensing the resistance of a resistor associated with the printhead and using changes in the sensed resistance to find the temperature changes.

7. The method of claim 1 wherein said initial operating and subsequent operating steps are repeated more than once to increase the accuracy of the measurement of the first temperature change and second temperature change.

8. The method of claim 1 wherein in said initial operating step the first firing frequency is near the maximum firing frequency for ejecting ink from the printhead.

9. The method of claim 4 wherein the number of ink chambers fired at the first firing frequency in said initial operating step is proportional to the number fired at said second firing frequency in said subsequent operating step so that the same power is delivered to the printhead for the first and second firing frequencies.

10. The method of claim 1 wherein said comparing step further includes obtaining a rate of change of the first temperature change and the second temperature change.

11. The method of claim 10, wherein the obtaining of the rate of change of the first temperature change and the second temperature change includes fitting a curve to data representing successive temperatures of the printhead and using the slope of the curve as the temperature rate of change.

12. The method of claim 1 wherein said comparing step includes taking the ratio of the first and second temperature changes.

13. The method of claim 1 further including an applying step using the low ink supply indication of the comparing step to trigger a low ink supply operating mode.

14. The method of claim 13 wherein said low ink supply operating mode includes warning an operator of imminent ink supply exhaustion.

15. The method of claim 1 wherein in said initial warming step and said subsequent warming step the first starting temperature and the second starting temperature are above an operating temperature of the printhead.

16. A method of operating a thermal inkjet printer to indicate a low ink supply in a thermal inkjet print cartridge, comprising the following steps:

initially warming a printhead in the inkjet print cartridge for a predetermined time;

initially operating the printhead by applying electrical pulses to an ink chamber in the printhead at a first firing frequency to eject a first volume of ink from the ink chamber, while monitoring the printhead temperature to obtain a first temperature change as compared to the first starting temperature;

subsequently warming the printhead in the inkjet print cartridge for a predetermined time;

subsequently operating the printhead by applying electrical pulses to an ink chamber in the printhead at a second firing frequency, which is different than the first firing frequency, to eject a second volume of ink from the ink chamber, while monitoring the printhead temperature to obtain a second temperature change as compared to the second starting temperature; and comparing the first temperature change and second temperature change as a basis for indicating a low ink supply in the print cartridge.

17. The method of claim 16 wherein in said initial warming step and said subsequent warming step the printhead is warmed above an operating temperature of the printhead.

18. A method of operating a thermal inkjet printer to indicate a low ink supply in a thermal inkjet print cartridge, comprising the following steps:

initially warming a printhead in the inkjet print cartridge for a predetermined time;

initially operating the printhead by applying electrical pulses to an ink chamber in the printhead at a first firing frequency to eject a first volume of ink from the ink chamber, while monitoring the printhead temperature to obtain a first temperature change as compared to the first starting temperature;

subsequently warming the printhead in the inkjet print cartridge for a predetermined time;

subsequently operating the printhead by applying electrical pulses to an ink chamber in the printhead at a second firing frequency, which is different than the first firing frequency, to eject a second volume of ink from the ink chamber, while monitoring the printhead temperature to obtain a second temperature change as compared to the second starting temperature;

obtaining the cooling rate for the first and second temperature changes;

correlating the obtained cooling rates with an ink volume according to a known calibration relationship, to ascertain the magnitude of the volume of ink ejected at the first firing frequency and the second firing frequency;

comparing the magnitude of the volume of ink ejected at said first and second frequencies to indicate a low ink supply.

19. The method of claim 18 further comprising the step of finding the calibration relationship before performing the correlating step.

20. The method of claim 19 wherein the calibration finding step comprises weighing the pen twice to determine a volume of ink ejected during the calibration-ascertaining step.

* * * * *